US006189195B1

(12) United States Patent
Reilly et al.

(10) Patent No.: US 6,189,195 B1
(45) **Date of Patent: *Feb. 20, 2001**

(54) MANUFACTURE OF PREFILLED SYRINGES

(75) Inventors: David M. Reilly, Glenshaw; Edward J. Rhinehart, Monroeville; Eugene A. Gelblum, Mt. Lebanon; Mark W. Hitchins, Sewickley; Michelle Robinson, Zelienople, all of PA (US)

(73) Assignee: Medrad, Inc., Indianola, PA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/517,645

(22) Filed: Aug. 22, 1995

(51) Int. Cl.[7] ..... B23P 15/00

(52) U.S. Cl. ..... 29/434; 29/422; 53/428

(58) Field of Search ..... 29/722, 429, 434, 29/469; 53/122, 428

(56) References Cited

U.S. PATENT DOCUMENTS

| | | |
|---|---|---|
| 3,105,335 | 10/1963 | Hickey . |
| 3,202,084 | 8/1965 | Hale et al. . |
| 3,634,997 | 1/1972 | Tait . |
| 4,267,769 | 5/1981 | Davis et al. . |
| 4,391,080 | 7/1983 | Brody et al. . |

(List continued on next page.)

FOREIGN PATENT DOCUMENTS

| | | |
|---|---|---|
| 682816 A5 | 3/1991 | (CH) . |
| 877372 | 1/1960 | (GB) . |
| 62-193703 | 2/1989 | (JP) . |
| WO95/12482 | 5/1995 | (WO) . |

OTHER PUBLICATIONS

"Molded Parts Discharged Without Opening The Mold", G. Galic and S. Maus, ANTEC 1991, pp. 412–416.
"Safer Syringes Boost Molder Opportunities", Plastics World / Aug. 1993, pp. 20–24, Carl Kirkland.
"SpritzgieBen im Reinraum", Maschinen, Garate, Verarbeitung, Carl Hanser Verlag, Munchen 1991, Kunstostoffe 81 (1991), pp. 768–770.

(List continued on next page.)

*Primary Examiner*—I Cuda Rosenbaum
(74) *Attorney, Agent, or Firm*—Gregory L. Bradley

(57) ABSTRACT

This invention relates to a process for manufacturing prefilled syringes where at least one of the syringe components is manufactured in at least a class 100 environment. The process includes the steps of manufacturing syringe components, such as the barrel and plunger substrate, within at least a class 100 and MCB-3 environment; manufacturing syringe components, such as the plunger cover and tip seal in an environment less clean than a class 100 environment; decontaminating the plunger cover and tip seal; lubricating at least one of the barrel, plunger substrate, plunger cover and tip seal; assembling the barrel and tip seal to form a barrel/tip seal combination; assembling the plunger cover and plunger substrate to form a plunger; filling the barrel/tip seal combination with a predetermined amount of fluid; and final assembling of the prefilled syringe by inserting the plunger into the barrel/tip seal combination. When the syringe components are manufactured at different locations, each component is tripled-bagged to maintain the component substantially free from contaminants, and transported to an assembly site where the components are unpackaged and assembled into the barrel/tip seal combination and plunger. When filling and final assembly of the barrel/tip seal combination takes place at a location separate from its assembly site, the barrel/tip seal combination is tripled-bagged to maintain it substantially free from contaminants, and transported to a filling and final assembling site for filling and final assembling into a prefilled syringe.

22 Claims, 8 Drawing Sheets

U.S. PATENT DOCUMENTS

| | | |
|---|---|---|
| 4,628,969 | 12/1986 | Jurgens, Jr. . |
| 4,660,464 | 4/1987 | Tanaka . |
| 4,677,980 | 7/1987 | Reilly . |
| 4,718,463 | 1/1988 | Jurgens, Jr. . |
| 4,880,581 | 11/1989 | Dastoli et al. . |
| 4,987,673 | 1/1991 | Kogura et al. . |
| 5,015,425 | 5/1991 | Mimata et al. . |
| 5,135,514 | 8/1992 | Kimber . |
| 5,141,430 | 8/1992 | Maus et al. . |
| 5,259,812 | 11/1993 | Kleinsek . |
| 5,316,560 | 5/1994 | Krone-Schmidt et al. . |
| 5,373,757 | 12/1994 | Reilly . |
| 5,511,594 | 4/1996 | Brennan et al. . |
| 5,535,746 | 7/1996 | Hoover et al. . |
| 5,620,425 | 4/1997 | Heffernan et al. . |

OTHER PUBLICATIONS

"Method For The Preparation Of Pre–filled Plastic Syringe", Request for Reexamination, Reexamination Control No. 90/004,870, Filed Dec. 12, 1997.

Clean Room Engineering p. 2,3, Clean Room Products, Inc. Industry News, XP 000613155, PSA Sep. 1991, "Disposable Syringes: Klückner standards for mass production", vol. 21 Jun. 1991 No. 1.

"Cleaning up with automation," *European Plastics News*, vol. 21. No. 7, (Jul./Aug. 1994), p. 25.

"Clean–room Injection Moulding," by H. Eckardt, *plast europe*, (Mar. 1992), pp. 54–55.

"Clean–room molding: An attractive specialty," by Debbie Stover, *Plastics Machinery& Equipment*, (Feb. 1989). pp. 33–37.

"(1116) Microbiological Evaluation and Classification of Clean Rooms and Clean Zones", *Pharmacopeial Forum*, vol. 18, No. 5, (Sep.–Oct. 1992), pp. 4048–4054.

*Cleanroom Design*, edited by W. Whyte, (1991), pp. 10, 58, 59, 128–133, 138–143, 156–157.

*Federal Standard 209E Airborne Particulate Cleanliness Classes in Cleanrooms and Clean Zones*, (Sep. 11, 1992), pp. 1–48.

"A Multicentred Investigation of Clean Air Requirements for Terminally Sterilized Pharmaceuticals," by W. Whyte, *Journal of Parenteral Science and Technology*, vol. 37, No. 4, (Jul.–Aug. 1983), pp. 138–144.

"The Influence of Clean Room Design on Product Contamination," by W. Whyte, *Journal of Parenteral Science and Technology*, vol. 38, No. 3, (May–Jun. 1984), pp. 103–108.

MANUFACTURE OF PREFILLED SYRINGES

TECHNICAL FIELD OF THE INVENTION

This invention relates in general to manufacturing processes for syringes, and more particularly to manufacturing processes for syringes prefilled with a fluid, such as a diagnostic contrast media or drug, where at least one of the syringe components is manufactured in at least a class 100 environment.

BACKGROUND OF THE INVENTION

Prefilled syringes provide convenience of use by eliminating the need to load the syringe with a fluid, such as contrast media, and by minimizing the need to purge air. Manufacturing processes for prefilled syringes are known in the art. For example, processes are known for producing prefilled, sterile glass syringes whereby the manufactured syringe components are washed and sterilized prior to partial assembly. The partially assembled glass syringe is filled with a fluid, sealed with a plunger, and sterilized once again by heating. U.S. Pat. Nos. 4,718,463 and 4,628,969, both issued to Jurgens, Jr. et al., teach a process for manufacturing plastic, prefilled syringes using repeated water jet washing of the syringe components prior to assembly and filling. Water washing is expensive because it requires ultra-purified water. Water washing is also troublesome because it is difficult to inspect and insure satisfactory cleaning. Therefore, it is desirable to reduce the number of washing steps required in the manufacture of prefilled syringes. Further, prior art syringe manufacturing processes do not provide precautionary steps to maintain syringe components substantially free from contaminants, such as viable and nonviable particles, during molding, assembly and filling. Therefore, it is desirable to develop a method for manufacturing prefilled syringes which substantially reduces viable and nonviable particles that may contaminate the syringe components during molding, assembly and filling.

SUMMARY OF THE INVENTION

This invention relates to a process for manufacturing prefilled syringes which reduces the number of component washing steps and permits the molding, assembly and filling of components substantially free of contaminants. A typical syringe which can be manufactured by the process of the invention includes a barrel, plunger substrate, plunger cover and tip seal.

In general the process begins by molding the barrel and plunger substrate from non-elastomeric material, such as polypropylene, polycarbonate or other medical grade plastic, within at least a class 100 environment. A class 100 environment, as used herein, is defined as an environment having no more than 100 viable or nonviable particles per cubic foot of air, 0.5 microns and larger. Further, this manufacturing environment should be at least a MCB-3 environment. A MCB-3 environment, as used herein, is defined as an environment wherein the microbial level of gram positive microorganisms is less than 3 cfu (colony forming unit) per cubic foot of air, and the microbial level of gram negative microorganisms is less than 1 cfu per cubic foot of air.

The molding temperature for the barrel and plunger substrate may be selected such that it renders these components substantially sterile and substantially free from contaminants. Any contaminants, such as particulate matter, that may exist in the air within the class 100 environment proximate to the components after molding may be removed from the class 100 environment by air flow. Thus, the barrel and plunger substrate manufactured under these conditions need not be washed.

The plunger cover and tip seal are molded from an elastomeric material, such as rubber, by any suitable molding method such as compression molding. As it is typically more difficult to compression mold these components within a class 100 environment due to the procedures and materials used, these components are manufactured in an environment less clean than a class 100 environment. Specifically, compression molded components are typically formed from a large sheet of rubber material. After the rubber has vulcanized in the mold, the entire sheet of molded components is removed from the mold and trimmed. The trimming process generates particulate matter from the cutoffs and lubrication that is used. Any contaminants that may exist on the plunger cover or tip seal after molding are removed by any suitable method, such as the use of ultrasonic or jet washing with freon or ultra-purified water, otherwise referred to as water-for-injection. The plunger cover and tip seal are then transferred to a class 100 environment.

After molding and contaminant removal, the plunger cover and tip seal are lubricated with silicone oil, hereinafter referred to as "silicone", to facilitate the assembly of the plunger cover onto the plunger substrate to form the plunger, and the assembly of the tip seal to the distal end of the barrel to form the barrel/tip seal combination. The plunger cover and tip seal may also require sterilization by any suitable method, such as use of ethylene oxide or autoclaving. After assembly of the plunger and the barrel/tip seal combination within at least a class 100 and MCB-3 environment, the barrel/tip seal combination is filled with a fluid, such as a contrast medium or drug, and the plunger is inserted therein to complete the assembly of the prefilled syringe.

Oftentimes different manufacturing steps take place at different locations. In this instance, it is desirable to package the components or partially assembled components in packaging that will maintain the components or partially assembled components substantially free from contaminants while being transported from one manufacturing location to another. In a preferred embodiment of the invention, the components or partially assembled components within at least a class 100 environment are "triple-bagged" to prevent contamination. Specifically, the components or partially assembled components are inserted into separate first and second containers, such as plastic bags, which are sealed to prevent entry of contamination. The packaged components or partially assembled components are then transferred to an environment less clean than a class 100 environment, such as a class 10,000 environment, where they are placed in a third container, such as a plastic bag, which is sealed to prevent entry of contaminants. A class 10,000 environment, as used herein, is defined as an environment having no more than 10,000 viable or nonviable particles per cubic foot of air, 0.5 microns and larger. The third bag is then placed in a shipping box for delivery to the next manufacturing location.

Upon arrival at the next manufacturing location, the shipping box is placed in an environment less clean than a class 100 environment, such as a class 10,000 environment. The packaged components or partially assembled components are then removed from the box and third bag, and placed in a feedthrough box connected to at least a class 100 environment, where they are removed from the second bag. The second bag remains in the feedthrough box, and the first bag containing the packaged components or partially assembled components is transported to into the class 100 environment. The packaged components or partially assembled components are removed from the first bag and set up for further manufacturing steps. It is understood that the components and partially assembled components can be transferred to any number of manufacturing locations by using the packaging and unpackaging procedures of the present invention.

In the manufacturing process of the invention, a salient technical advantage is that the number of washing steps required by the prior art is substantially reduced and the syringe components are molded, assembled and filled substantially free from contaminants.

DETAILED DESCRIPTION

Figure 1:
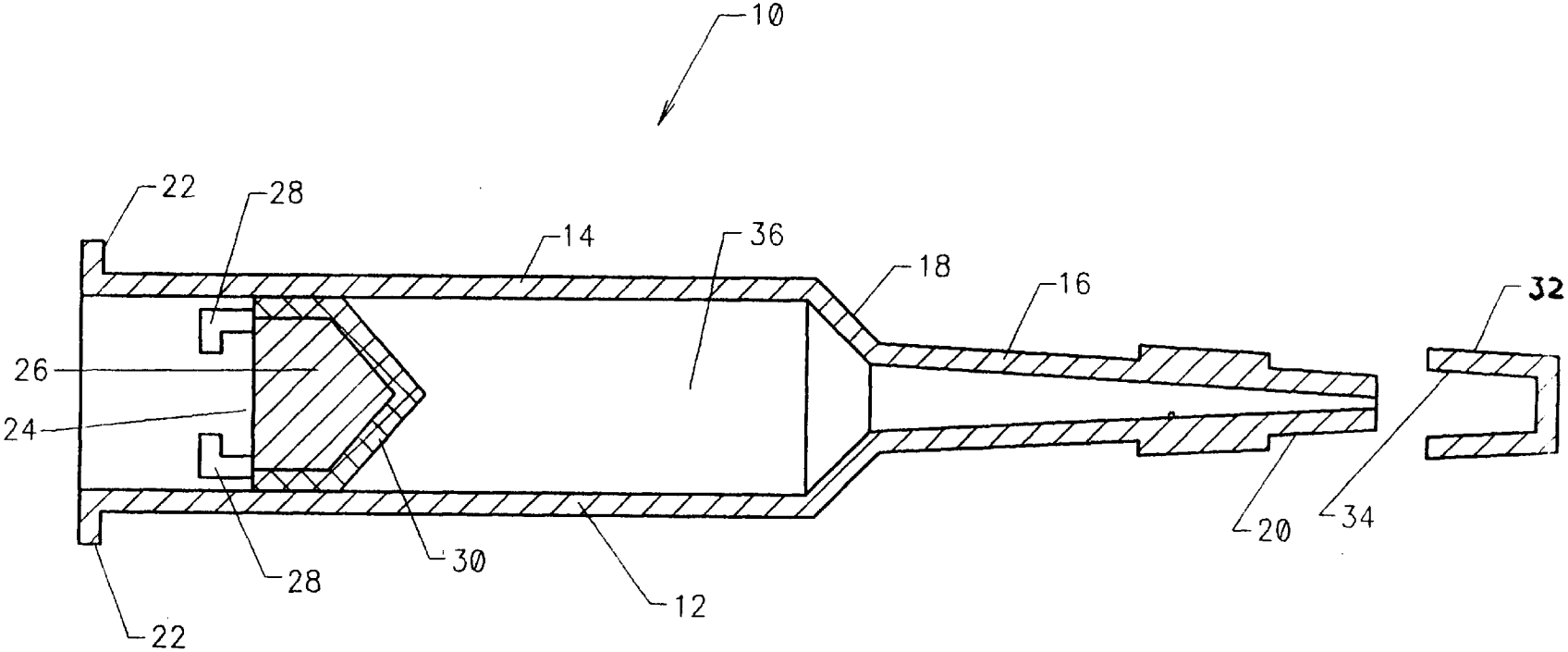
FIG. 1 is an axial sectional view of a representative syringe which may be manufactured according a syringe manufacturing process of the invention.

The manufacturing process of the invention may be used to manufacture a syringe, such as syringe 10 shown in FIG. 1. Syringe 10 comprises several components including a barrel 12 having a cylindrically-shaped body 14 and a tapered nozzle section 16 joined together by a tapered conical section 18. Tip 20 of nozzle section 16 forms the distal end of syringe 10. Flange 22 is located on the body 14 at the proximal end of barrel 12 to secure syringe 10 within an injector pressure jacket (not shown), such as the pressure jacket described in U.S. Pat. No. 4,677,980. Alternatively, syringe 10 may include mounting flanges (not shown) at its proximal end and to facilitate attachment to a front-loading injector, as described in U.S. Pat. No. 5,383,858.

Syringe 10 further comprises a plunger 24 which is sealingly engaged within the body 14. Plunger 24 typically includes a plunger substrate 26 and legs 28 extending therefrom to engage the drive piston (not shown) of the injector (not shown). Plunger 24 may further include a plunger cover 30 attached to the plunger substrate 26. Alternatively, plunger 24 may be made of a single piece including legs 28. Tip seal 32 having an interior surface 34 is attached to syringe tip 20 by any suitable means, such as friction or screw threads (not shown). Typically, the barrel 12 and plunger substrate 26 are manufactured from a non-elastomeric material, such as polypropylene and polycarbonate, respectively, and the plunger cover 30 and tip seal are manufactured from an elastomeric material, such as rubber. For details considering the structure and operation of syringe 10, reference is made to U.S. Pat. Nos. 4,677,980 and 5,383,858 assigned to the common assignee of this application. These patents are fully incorporated herein by reference for their description of syringes and injectors. When syringe 10 is manufactured with a predetermined amount of fluid 36 contained within barrel 12, the syringe is referred to as a "prefilled syringe."

Figure 2A:
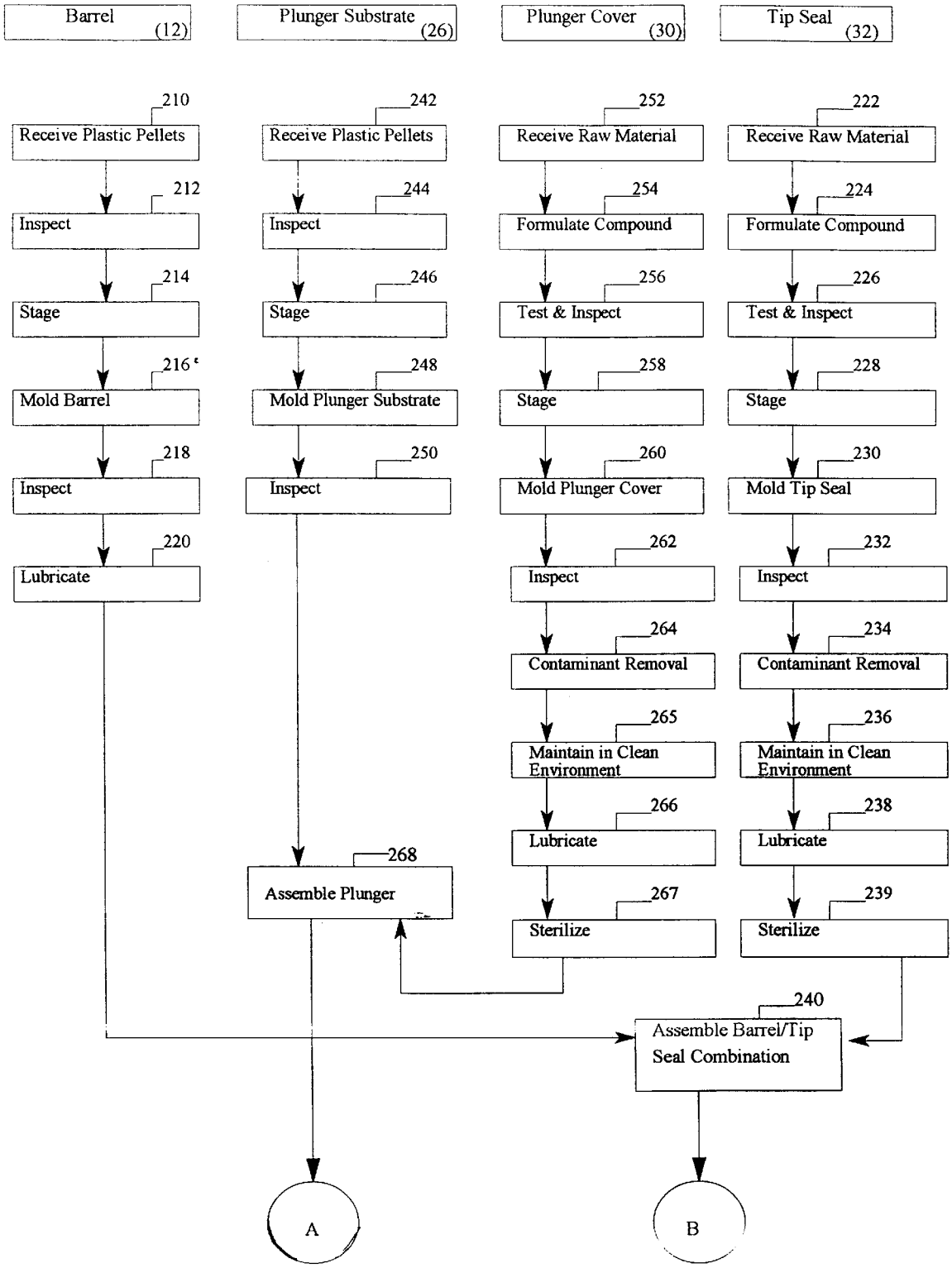
FIGS. 2*a* and 2*b* together comprise a flow diagram of a syringe manufacturing process according to a first embodiment of the invention.
Figure 2B:
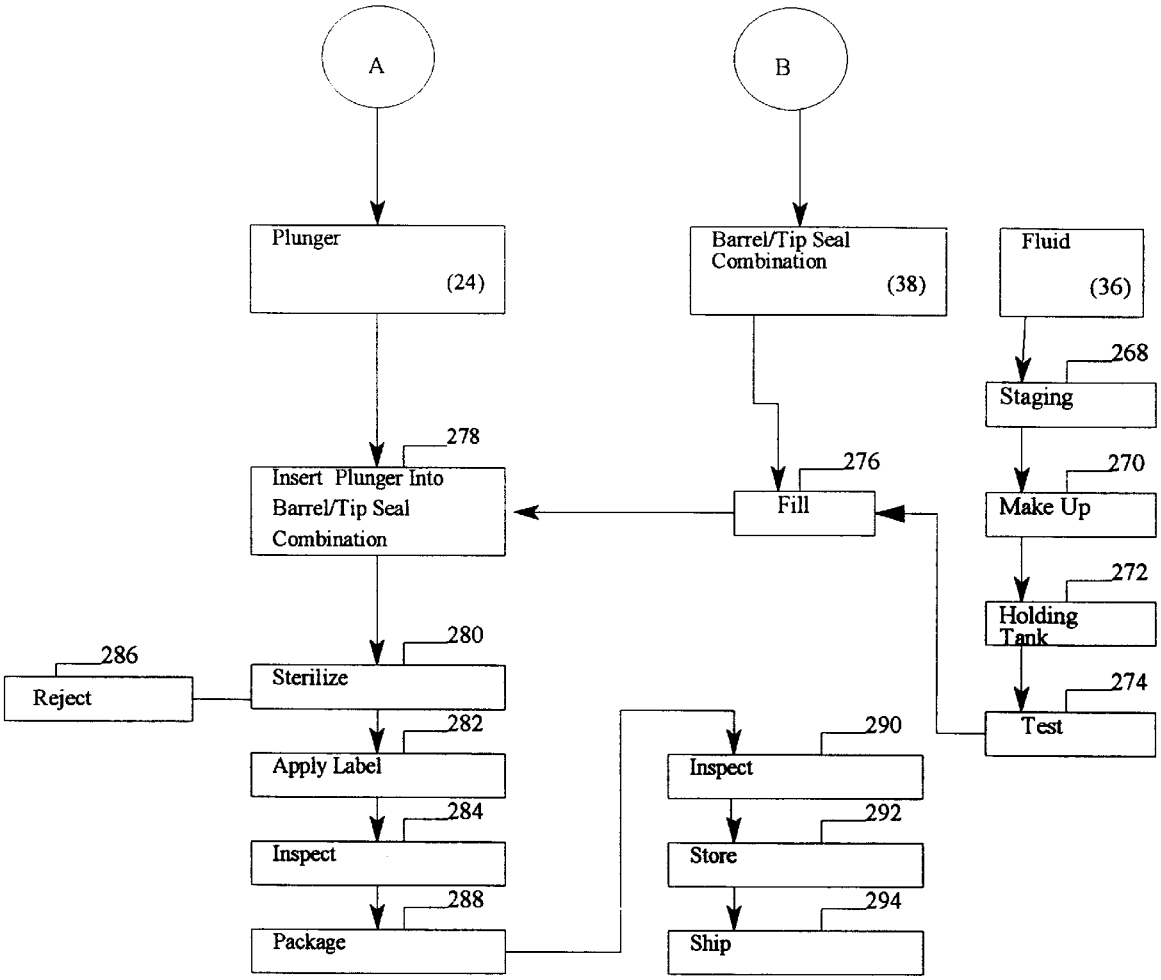

The first embodiment of the process invention is demonstrated in the flow diagram of FIGS. 2*a* and 2*b*. In this embodiment, all of the manufacturing activities for syringe 10 are performed within the same manufacturing location. With respect to barrel 12, plastic pellets for barrel 12 are received at step 210, inspected at step 212 and staged at step 214. Barrel 12 is molded at step 216 within at least a class 100 environment, at a temperature sufficient to render barrel 12 substantially free from contaminants. The manufacturing environment should also be at least a MCB-3 environment. Any particulate matter that may exist in the air proximate to the barrel 12 after the molding process is diverted away from barrel 12 by any suitable means, such as air flow. Thus, barrel 12 need not be decontaminated or otherwise washed. Barrel 12 is inspected at step 218 and its inside surface is lubricated with any suitable lubrication means, such as silicone, at step 220. Lubrication is required because barrel 12 receives plunger 24 having a rubber cover 30.

The raw material for tip seal 32 is received at step 222. The molding compound for tip seal 32 is formulated at step 224, tested and inspected at step 226, and staged at step 228. Tip seal 32 is molded out of the compound at step 230 in an environment less clean than a class 100 environment and is inspected at step 232. Contaminants on the tip seal 32 surface are then removed at step 234 by any suitable method, such as the use of ultrasonic or jet washing with freon or ultra-purified water. After contaminant removal, tip seal 32 is maintained in at least a class 100 environment at step 236 and lubricated at step 238 with any suitable lubrication means, such as silicone. It is understood that tip seal 32 may also be lubricated while being decontaminated at step 234. Tip seal 32 may also be sterilized at step 239, by any suitable sterilization method, such as use of ethylene oxide or autoclaving. Barrel 12 and tip seal 32 are then assembled at step 240 to form a barrel/tip seal combination.

Non-elastomeric material, such as polypropylene pellets, is received for the plunger substrate 26 at step 242, inspected at step 244 and staged at step 246. Similar to barrel 12, plunger substrate 26 is molded at step 248 in at least a class 100 environment at a temperature sufficient to render the plunger substrate 26 substantially free from contaminants. The manufacturing environment should also be at least a MCB-3 environment. Any particulate matter that may exist in the air proximate to the plunger substrate 26 after the molding process is diverted away from plunger substrate 26 by any suitable means, such as air flow. Thus, the plunger substrate 26 need not be decontaminated or otherwise washed. Plunger substrate 26 is then inspected at step 250.

Elastomeric material, such as rubber, for the plunger cover 30 is received at step 252. The molding compound for the plunger cover 30 is formulated at step 254, tested and inspected at step 256 and staged at step 258. Plunger cover 30 is molded from the molding compound at step 260 in an environment less clean than a class 100 environment and inspected at step 262. Any contaminants that may exist on the surface of the plunger cover 30 are then removed by any suitable method at step 264, such as using ultrasonic or jet washing with freon or ultra-purified water. Plunger cover 30 is then maintained in at least a class 100 environment at step 265 and lubricated at step 266 by any suitable lubrication means, such as silicone. It is understood that plunger cover 30 may also be lubricated while being decontaminated at step 264. As with tip seal 32, plunger cover 30 may also be sterilized at step 267 by any suitable method. Plunger cover 30 and plunger substrate 26 are assembled at step 268.

As shown in FIG. 2*b*, the fluid 36, such as contrast medium, for filling the prefillable syringe 10, is staged at step 268, made up at step 270, placed in a holding tank at step 272 and tested at step 274. The barrel/tip seal combination is then filled with the fluid 36 by any suitable filling method at step 276 and plunger 24 is then inserted into the filled barrel/tip seal combination at step 278.

Figure 5:
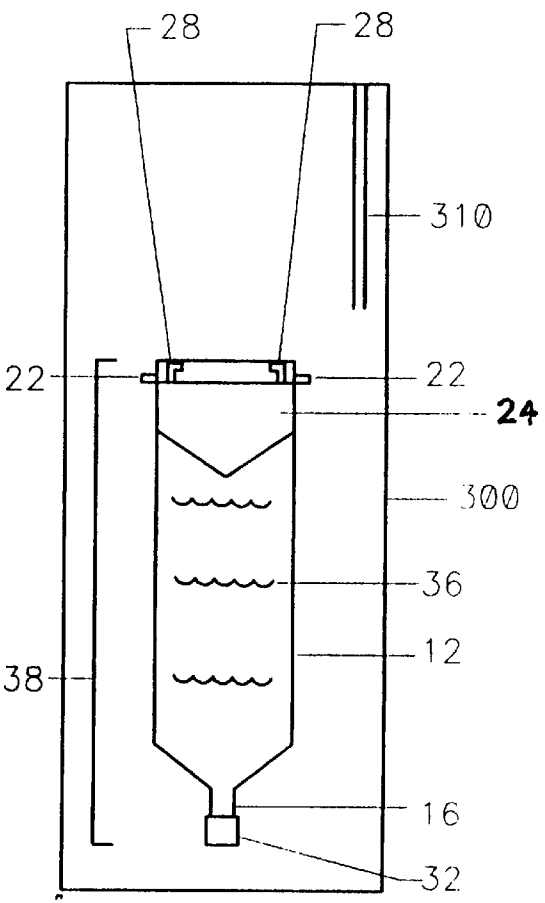
FIGS. 3–5 are schematic block diagrams showing successive steps in a filling and final syringe assembly procedure according to a syringe manufacturing process of the invention.
Figure 4:
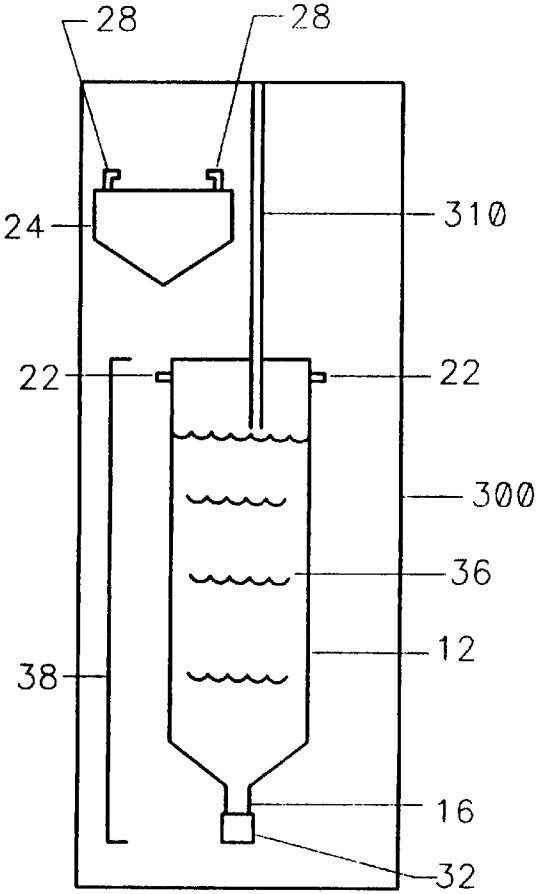
Figure 3:
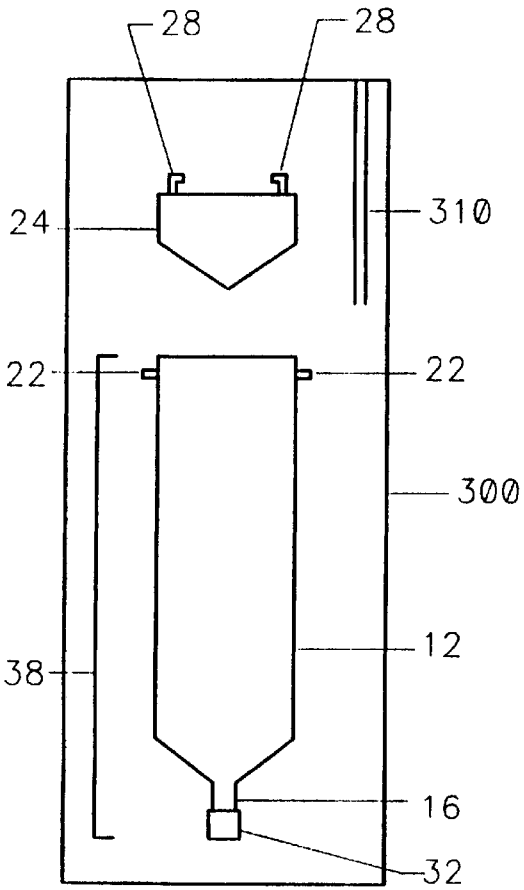

FIGS. 3–5 show the progressive stages of a preferred method for filling the barrel/tip seal combination, identified by reference numeral 38. As demonstrated in FIG. 3, the barrel/tip seal combination 38 and plunger 24 are placed inside of a hermetic enclosure 300 located within a clean environment, preferably at least a class 100 and MCB-3 environment. Filling tube 310 for introducing fluid 36 into the barrel/tip seal combination 38 also extends into the enclosure 300. Barrel/tip seal combination 38 and plunger 24 are held in place by appropriate retaining means, such as clamps or the like (not shown). Class 100 air within the enclosure 300 is then evacuated.

As shown in FIG. 4, filling tube 310 is used to inject fluid 36, such as a contrast medium, into the proximal end of the barrel/tip seal combination 38. Prior to filling, fluid 36 is staged according to the manufacturing process described in accordance with FIGS. 2*a* and 2*b*. After a predetermined level of fluid 36 is injected into the barrel/tip seal combination 38, fluid flow through tube 310 is terminated.

After the barrel/tip seal combination 38 is filled with fluid 38, plunger 24 is moved by an articulable arm (not shown) or the like and inserted into the barrel/tip seal combination 38. The outside surface of the plunger 24 forms a hermetic seal with the interior sidewalls of the barrel/tip seal combination 38. Class 100 air is then reintroduced into enclosure 300 and the completely assembled, prefilled syringe 10 is removed therefrom. The process is then repeated for each subsequent barrel/tip seal combination 38 and plunger 24. It is understood that suitable machinery can be designed to perform this filling and final assembly step on a plurality of barrel/tip seal combinations 38 and plungers 24 at the same time.

The filling process described herein prohibits air from entering into barrel/tip seal combination 38, which would be medically undesirable. Tip seal 32 located at the distal end of syringe 10 and plunger 24 located near the proximal end of syringe 10 provide, in combination with the sidewalls of the syringe 10, a hermetic seal to contain the injectable fluid 36. The filling and final assembly process results in a prefilled, sterile syringe 10 which subsequently can be speedily mounted onto an injector head (not shown) by the user. A technical advantage is provided in that the user need not fill the syringe 10 through the tip 20, but can proceed directly to a fluid injection procedure.

Referring back to FIG. 2*b*, the completed prefilled syringe 10, which may be placed in a protective pouch, is then sterilized at step 280 by any suitable method, such as autoclaving, labeled at step 282, and inspected at step 284. A prefilled syringe 10 that does not meet predetermined requirements is rejected at step 286. A prefilled syringe that meets predetermined requirements is packaged at step 288, by any suitable packaging means, inspected again at step 290, stored at step 292 and shipped at step 294.

Figure 6A:
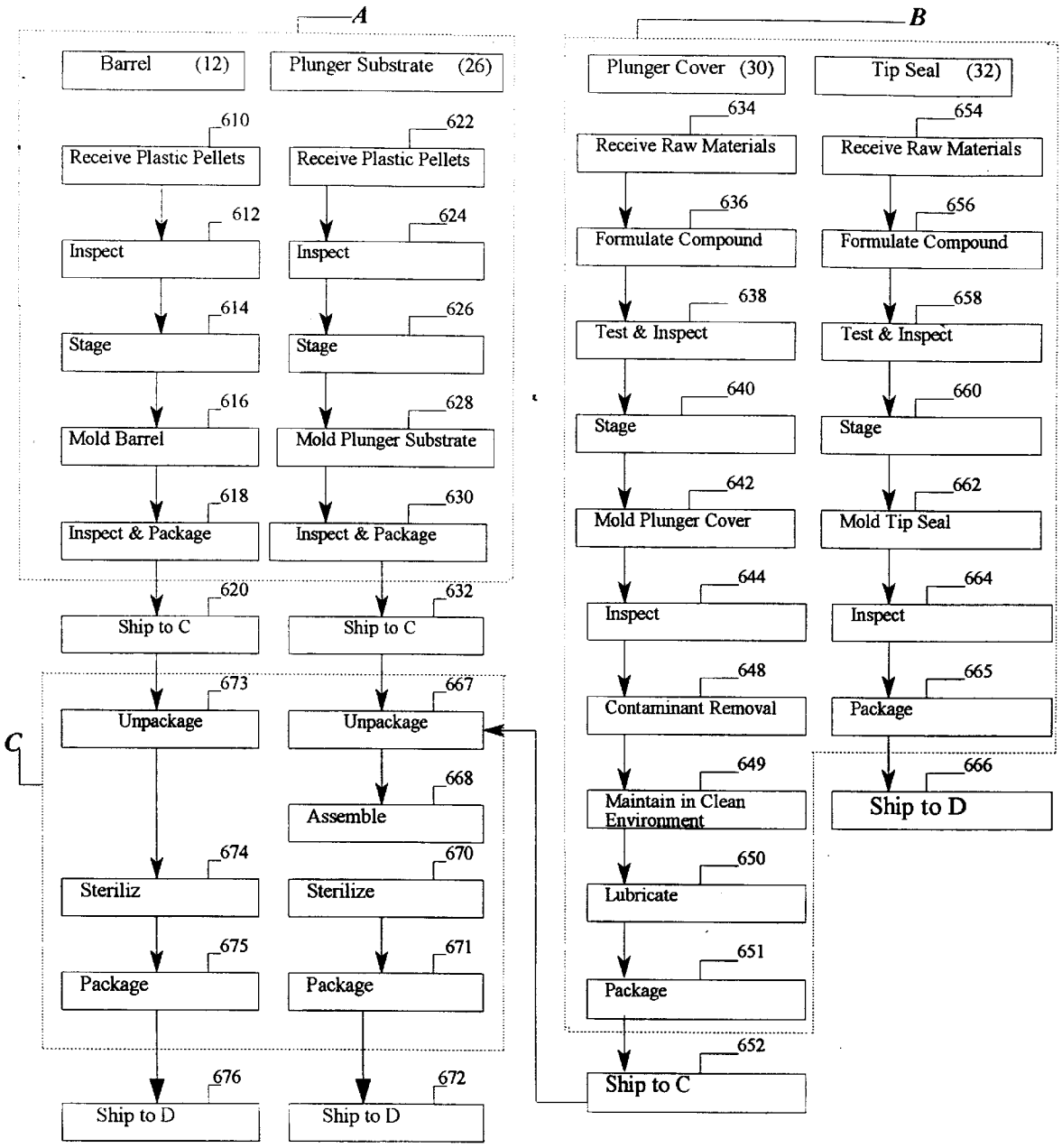
FIGS. 6*a* and 6*b* together comprise a flow diagram of a syringe manufacturing process according to a second embodiment of the invention.
Figure 6B:
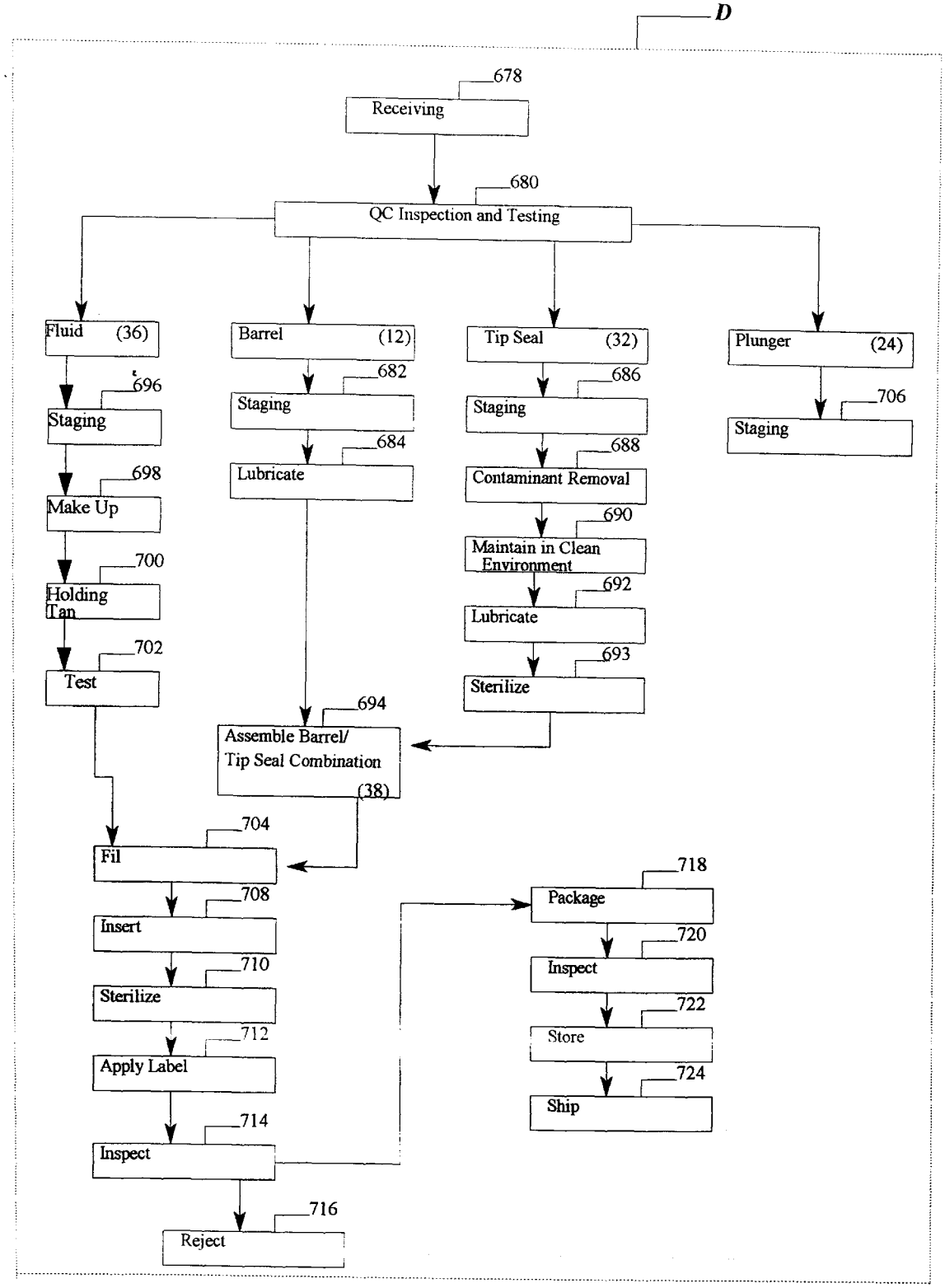

The second embodiment of the process invention is depicted in the flow diagrams of FIGS. 6*a* and 6*b*. In this embodiment, the manufacturing process takes place at separate manufacturing locations such as locations designated A, B, C and D, as shown by the dashed enclosures of FIGS. 6*a* and 6*b*. The barrel 12 and plunger substrate 26 are molded in at least a class 100 and MCB-3 environment designated as site A in FIG. 6*a*, by any suitable molding method such as injection molding. Plunger cover 30 and tip seal 32 are typically molded by compression molding which normally takes place in an environment less clean than a class 100 environment, designated as site B.

Referring to FIG. 6*a*, polypropylene pellets are received at step 610, inspected at step 612 and staged at step 614. Similar to the molding process of FIG. 2*a*, barrel 12 is molded at step 616 in at least a class 100 environment at a temperature sufficient to render barrel 12 substantially free from contaminants. Any particulate matter that may exist in the air proximate to the barrel 12 after the molding process is diverted away from barrel 12 by any suitable means, such as air flow. Thus, barrel 12 need not be decontaminated or otherwise washed. Barrel 12 is then inspected and packaged at step 618. It is understood that barrel 12 may also be lubricated by any suitable means after being molded at step 616.

Figure 7:
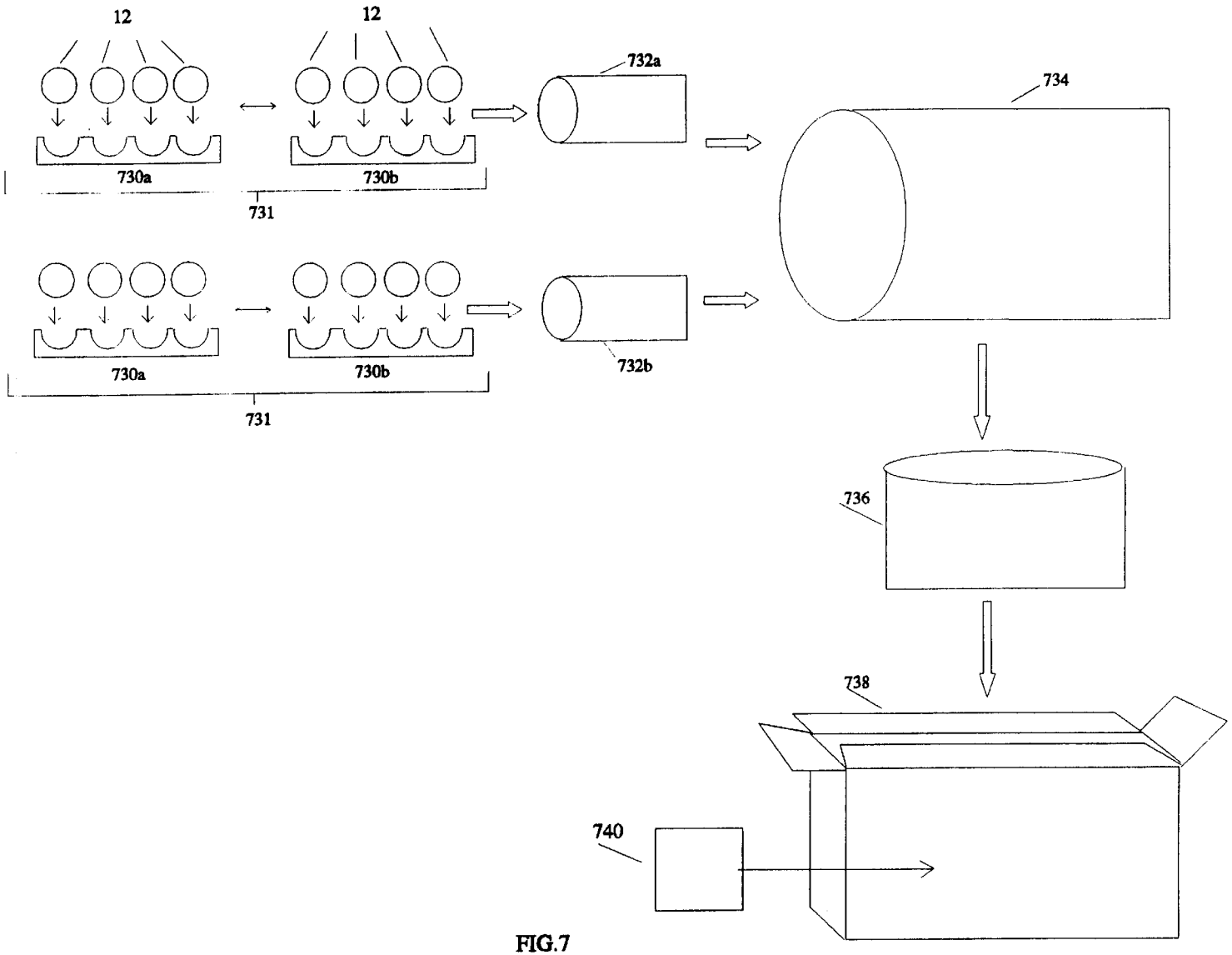
FIG. 7 is a schematic diagram showing successive steps in a packaging process according to the invention.

In a preferred embodiment of the invention, barrel 12 is packaged according to the procedure depicted in FIG. 7. While within a class 100 and MCB-3 environment, a plurality of barrels 12, such as four, are placed in a holder 730*a*. Another plurality of barrels 12, such as four, are placed in a holder 730*b* mateable with holder 730*a* to form a single clip 731. Clip 731 along with its barrels 12 are then inserted into a first container, such as plastic bag 732*a* which is then sealed by any suitable means, such as heat sealing. A second barrel 12 and clip 731 assembly can be inserted into another first container, such as plastic bag 732*b* which is then sealed. Bags 732*a* and 732*b* are then inserted into a second container, such as plastic bag 734, which is sealed by any suitable means, such as heat sealing. Plastic bag 734 may then be transported to an environment less clean than a class 100 environment, such as a class 10,000 environment, and inserted into a third container, such as plastic bag or carton liner 736 which is sealed by any suitable means, such as a tie or other clasp (not shown). Carton liner 736 is then inserted into a shipping container, such as container 738 which is closed for shipping. A label (not shown) may be applied to the outer surface of bags 732*a*, 732*b*, 734 and 736 to identify the contents. Further, label 740 may be applied to the outer surface of container 738 to identify the contents or provide shipping instructions. As shown in FIG. 6*a*, after barrel 12 has been packaged at step 618, it is shipped to site C at step 620. It is understood that the packaging materials used to package the syringe components must themselves be substantially free from contaminants to maintain the cleanliness of the components.

Plunger substrate 26 may also be molded at site A. Polycarbonate pellets are received at step 622, inspected at step 624 and staged at 626. Similar to barrel 12, plunger substrate 26 is molded at step 628 in at least a class 100 and MCB-3 environment at a temperature sufficient to render plunger substrate 26 substantially free from contaminants. Any particulate matter that may exist proximate to the plunger substrate 26 after the molding process is diverted away from plunger substrate 26 by any suitable means, such as air flow. Thus, plunger substrate 26 need not be decontaminated or otherwise washed. The molded plunger substrate 26 is then inspected and packaged at step 630. In a preferred embodiment, plunger substrate 26 is packaged according to the packaging procedure previously described in accordance with FIG. 7. After packaging, the plunger substrate 26 is shipped to site C at step 632.

The plunger cover 30 is molded at site B, typically an environment less clean than a class 100 environment. As shown in FIG. 6*a*, raw materials for the plunger cover 30 are received at step 634. The molding compound for the cover 30 is formulated at step 636, tested and inspected at step 638, and staged at step 640. Plunger cover 30 is molded at step 642 in an environment less clean than a class 100 environment, and again inspected at step 644. To remove any contaminants that may exist on the plunger cover 30 after molding, any suitable method may be used, such as use of ultrasonic or jet washing with freon or ultra-purified water. After removing contaminants, the plunger cover 30 is maintained in a clean environment at step 649, such as at least a class 100 environment. The inside surface of plunger cover 30 is then lubricated at step 650 using any suitable lubrication means, such as silicone, to facilitate its attachment to plunger substrate 26. After lubrication, plunger cover 30 is packaged at step 651 in accordance with the procedure previously described in connection with FIG. 7, and shipped to a site C at step 652.

Similar to plunger cover 30, tip seal 32 is manufactured at site B. Plunger cover 30 and tip seal 32 need not be manufactured from the same materials. As shown in FIG. 6*a*, raw materials for the tip seal 32, are received at step 654 and the tip seal molding compound is formulated at step 656. The tip seal compound is tested and inspected at step 658 and staged for molding at step 660. Tip seal 32 is molded at step 662 in an environment less clean than a class 100 environment, inspected at step 664, packaged at step 665 according to the procedure of FIG. 7, and shipped to site D at step 666. It is understood that contaminants may be removed from the surface of tip seal 32 and tip seal 32 may be lubricated at site B. If so, after contaminant removal and lubrication, tip seal 32 is packaged according to the procedure previously described in accordance with FIG. 7, prior to shipping to site D.

At site C, plunger substrate 26 and plunger cover 30 are removed from their respective packaging at step 667. In a preferred embodiment, these components are unpackaged according to the procedure depicted in FIG. 8. For ex ample, packaged plunger substrates 26 are received at site C in an environment less clean than a class 100 environment, such as a class 10,000 environment, and are removed from shipping container 738 and third container or liner 736, at steps 810 and 812. To minimize contamination, removal from the third container takes place proximate to the feedthrough box just prior to inserting the packaged plunger substrates 26 into the feedthrough box. At step 814, packaged plunger substrates 26 in the second container 734 are inserted into a feedthrough box connected to at least a class 100 environment, where the second container 734 is removed. After removal of the second container 734, the packaged plunger substrates 26 within the first containers 732*a* and 732*b* are transported into the class 100 environment where the plunger substrates 26 are removed from the first containers 732*a* and 732*b* and placed into a holder (not shown), at steps 816 and 818. The packaged plunger covers 30 are similarly unpackaged in accordance with the procedure shown in FIG. 8.

After a plunger substrate 26 and plunger cover 30 have been unpackaged, they are assembled at step 668 to form a plunger 24 which is subsequently sterilized at step 670, by any suitable means, such as the use of ethylene oxide. After sterilization, plunger 24 is packaged in accordance with FIG. 7 at step 671 and then shipped to site D at step 672.

Figure 8:
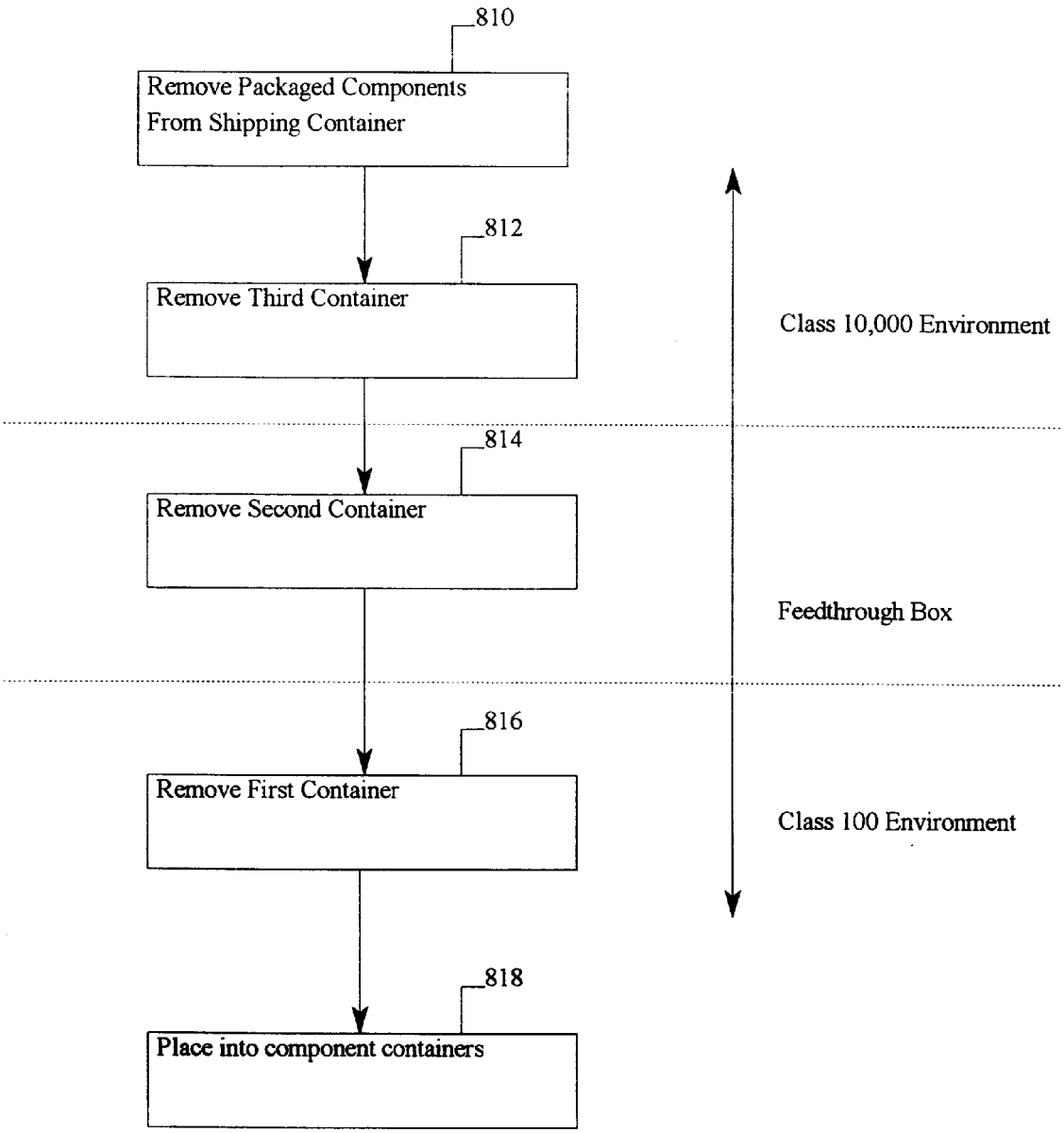
FIG. 8 is a process flow diagram showing steps in an unpackaging process according to the invention.

Similarly, barrel 12 is unpackaged at site C at step 673 according to the procedure depicted in FIG. 8, and sterilized by any suitable means, such as the use of ethylene oxide at step 674. Sterilized barrel 12 is then repackaged according to the procedure of FIG. 7 at step 675 and shipped to cite D at step 676.

Referring to FIG. 6*b*, the plunger 24, barrel 12, tip seal 32, all packaged according to the steps of FIG. 7 and unpackaged according to the steps of FIG. 8, and fluid 36 used to fill syringe 10, are received at a receiving step 678 and undergo quality control inspection and testing at step 680. Within at least a class 100 and MCB-3 environment, barrel 12 is staged at step 682 and the inside surface of barrel 12 is lubricated by any suitable lubrication means, such as silicone, at step 684 to facilitate insertion of plunger 24. If contaminants on tip seal 32 were not previously removed at site B, tip seal 32 is placed in an environment less clean than a class 100 environment, staged at step 686, and decontaminated at step 688 by any suitable means to remove any contaminants that may have accumulated. After decontamination, tip seal 32 is maintained in at least a class 100 and MCB-3 environment at step 690, and then lubricated at step 692 by any suitable means, such as silicone. Tip seal 32 may also be sterilized at step 693 by any suitable method, such as use of ethylene oxide or autoclaving. The barrel 12 and tip seal 32 are then assembled to form a barrel/tip seal combination 38 at step 694.

The fluid 36 used in syringe 10, such as contrast medium, is staged at step 696, made up at step 698, put into a holding tank at step 700, and tested at step 702. As shown in FIG. 6*b*, at step 704, the barrel/tip seal combination 38 is filled with fluid 36, preferably by the process previously described in reference to FIGS. 3–5. After filling, plunger 24 is inserted into the barrel/tip seal combination 38 at step 708 to complete the prefilled syringe 10, and may be placed in a protective container. At step 710, the prefilled syringe 10 is sterilized by any suitable method, such as autoclaving. It is understood that during autoclaving of a prefilled syringe, varying pressures are exerted on the syringe. Providing a gas overpressure during the autoclaving procedure to minimize stress on the barrel 12 to prevent plunger movement due to pressure fluctuations is known to those skilled in the art. After sterilizing, an identifying label is affixed to syringe 10, or its protective container, at step 712. Syringe 10 is then inspected in accordance with predetermined requirements at step 714, and if found to be non-conforming, it is rejected at step 716. If syringe 10 meets the predetermined requirements, it is then packaged at step 718, inspected at step 720, stored at step 722 and ultimately shipped at step 724.

Alternatively, after the assembly of the barrel/tip seal combination 38 at step 694, it is understood that the barrel/tip seal combination 38 could be packaged according to the process of FIG. 7, transported to at least a class 100 and MCB-3 filling and final assembly site (not shown), unpackaged according to the procedure of FIG. 8, and filled and finally assembled according to the procedure of FIGS. 3–5.

Although the manufacturing processes of the invention have been described in detail for the purpose of illustration, it is to be understood that such detail is solely for that purpose and that variations can be made thereto by those skilled in the art without departing from the spirit and scope of the invention except as it may be limited by the claims.

We claim:

1. A process of manufacturing a syringe, the process comprising:

molding a barrel and a plunger substrate within at least a class 100 environment, without subsequently washing the barrel and the plunger substrate;

packaging the barrel and plunger substrate within at least a class 100 environment, thereby maintaining the barrel and the plunger substrate substantially free of contaminants;

molding a plunger cover and a tip seal within an environment less clean than a class 100 environment;

packaging the plunger cover and the tip seal within at least a class 100 environment, thereby maintaining the plunger cover and the tip seal substantially free of contaminants;

transporting the packaged barrel and the packaged tip seal to a first assembly site having at least a class 100 environment;

unpackaging the barrel and the tip seal within the at least class 100 environment at the first assembly site;

assembling the unpackaged tip seal to the unpackaged barrel within the at least class 100 environment at the first assembly site, thereby providing a barrel/tip seal combination;

transporting the packaged plunger substrate and the packaged plunger cover to a second assembly site having at least a class 100 environment;

unpackaging the plunger substrate and the plunger cover within the at least class 100 environment at the second assembly site;

assembling the unpackaged plunger cover to the unpackaged plunger substrate within the at least class 100 environment at the second assembly site, thereby providing a plunger assembly;

packaging the barrel/tip seal combination within at least a class 100 environment, thereby maintaining the barrel/tip seal combination substantially free of contaminants;

packaging the plunger assembly within at least a class 100 environment, thereby maintaining the plunger assembly substantially free of contaminants;

transporting the packaged barrel/tip seal combination and the packaged plunger assembly to a final assembly site having least a class 100 environment;

unpackaging the barrel/tip seal combination and the plunger assembly within the at least class 100 environment at the final assembly site; and assembling the unpackaged plunger assembly to the unpackaged barrel/tip seal combination within the at least class 100 environment at the final assembly site.

2. A process of manufacturing a syringe, the process comprising:

molding a barrel and a plunger substrate within at least a class 100 environment;

packaging the barrel and the plunger substrate within at least a class 100 environment, thereby maintaining the barrel and the plunger substrate substantially free of contaminants;

molding a plunger cover and a tip seal within an environment less clean than a class 100 environment;

packaging the plunger cover and the tip seal within at least a class 100 environment, thereby maintaining the plunger cover and the tip seal substantially free of contaminants;

transporting the packaged barrel and the packaged tip seal to a first assembly site having at least a class 100 environment;

unpackaging the barrel and the tip seal within the at least class 100 environment at the first assembly site;

assembling the unpackaged tip seal to the unpackaged barrel within the at least class 100 environment at the first assembly site, thereby providing a barrel/tip seal combination;

transporting the packaged plunger substrate and the packaged plunger cover to a second assembly site having at least a class 100 environment;

unpackaging the plunger substrate and the plunger cover within the at least class 100 environment at the second assembly site;

assembling the unpackaged plunger cover to the unpackaged plunger substrate within the at least class 100 environment at the second assembly site, thereby providing a plunger assembly;

inserting each of the barrel/tip seal combination and the plunger assembly into a respective first container within at least a class 100 environment, thereby maintaining the barrel/tip seat combination and the plunger assembly substantially free of contaminants;

sealing the respective first containers;

inserting the respective sealed first containers into respective second containers;

sealing the respective second containers;

inserting the respective sealed second containers into respective third containers;

sealing the respective third containers;

transporting the packaged barrel/tip seal combination and the packaged plunger assembly to a final assembly site having least a class 100 environment;

unpackaging the barrel/tip seal combination and the plunger assembly within the at least class 100 environment at the final assembly site; and assembling the unpackaged plunger assembly to the unpackaged barrel/tip seal combination within the at least class 100 environment at the final assembly site.

3. A process of manufacturing a syringe, the process comprising:

molding a barrel and a plunger substrate within at least a class 100 environment, without subsequently washing the barrel and the plunger substrate;

molding a plunger cover and a tip seal within an environment less clean than a class 100 environment;

inserting each of the barrel, the plunger substrate, the plunger cover and the tip seal into respective first containers within at least a class 100 environment, thereby maintaining the barrel, the plunger substrate, the plunger cover and the tip seal substantially free of contaminants;

sealing the respective first containers;

inserting the respective sealed first containers into respective second containers;

sealing the respective second containers;

inserting the respective sealed second containers into respective third containers;

sealing the respective third containers;

transporting the packaged barrel and the packaged tip seal to a first assembly site having at least a class 100 environment;

unpackaging the barrel and the tip seal within the at least class 100 environment at the first assembly site;

assembling the unpackaged tip seal to the unpackaged barrel within the at least class 100 environment at the first assembly site, thereby providing a barrel/tip seal combination;

transporting the packaged plunger substrate and the packaged plunger cover to a second assembly site having at least a class 100 environment;

unpackaging the plunger substrate and the plunger cover within the at least class 100 environment at the second assembly site;

assembling the unpackaged plunger cover to the unpackaged plunger substrate within the at least class 100 environment at the second assembly site, thereby providing a plunger assembly;

packaging the barrel/tip seal combination within at least a class 100 environment, thereby maintaining the barrel/tip seal combination substantially free of contaminants;

packaging the plunger assembly within at least a class 100 environment, thereby maintaining the plunger assembly substantially free of contaminants;

transporting the packaged barrel/tip seal combination and the packaged plunger assembly to a final assembly site having least a class 100 environment;

unpackaging the barrel/tip seal combination and the plunger assembly within the at least class 100 environment at the final assembly site; and assembling the unpackaged plunger assembly to the unpackaged barrel/tip seal combination within the at least class 100 environment at the final assembly site.

4. The process of claim 1 wherein the barrel and plunger substrate are molded within at least a MCB-3 environment.

5. The process of claim 1 wherein the first assembly site is at least a MCB-3 environment.

6. The process of claim 1, further comprising the steps of:

prior to packaging the plunger cover and tip seal;

decontaminating and lubricating the plunger cover and tip seal.

7. The process of claim 1 wherein each packaging step comprises the steps of:

inserting each of the barrel, plunger substrate, plunger cover and tip seal into respective first containers;

sealing the respective first containers;

inserting the respective sealed first containers into respective second containers;

sealing the respective second containers;

transporting the respective sealed second containers to an environment less clean than a class 100 environment;

inserting the respective sealed second containers into respective third containers; and sealing the respective third containers.

8. The process of claim 7, further comprising the steps of:

prior to transporting the packaged barrel and packaged tip seal to the first assembly site, transporting the packaged barrel and packaged tip seal to a receiving site being less clean than a class 100 environment;

removing each of the packaged barrel and packaged tip seal from the respective sealed third containers;

transporting the packaged barrel and packaged tip seal to a feedthrough area; and removing each of the packaged barrel and packaged tip seal from the respective sealed second containers.

9. The process of claim 8, further comprising the steps of:

after transporting each of the packaged barrel and packaged tip seal to the first assembly site, removing each of the packaged barrel and packaged tip seal from the respective sealed first containers.

10. The process of claim 7, further comprising the steps of:

prior to transporting the packaged plunger substrate and packaged plunger cover to the second assembly site, transporting the packaged plunger substrate and packaged plunger cover to a receiving site being less clean than a class 100 environment;

removing each of the packaged plunger substrate and packaged plunger cover from the respective sealed third containers;

transporting the packaged plunger substrate and packaged plunger cover to a feedthrough area; and removing each of the packaged plunger substrate and packaged plunger cover from the respective sealed second containers.

11. The process of claim 10, further comprising the step of:

after transporting each of the packaged plunger substrate and packaged plunger cover to the second assembly site, removing each of the packaged plunger substrate and packaged plunger cover from the respective sealed first containers.

12. The process of claim 1, further comprising the steps of:

after forming the barrel/tip seal combination, packaging the barrel/tip seal combination to maintain it substantially free from contaminants;

after forming the plunger, packaging the plunger to maintain it substantially free from contaminants;

transporting the packaged barrel/tip seal combination and packaged plunger to a final assembly site which is at least a class 100 environment; and finally assembling the syringe by inserting the plunger into the barrel/tip seal combination to form a prefilled syringe.

13. The process of claim 1 wherein the final assembly site is at least a MCB-3 environment.

14. The process of claim 1 wherein the steps of packaging the barrel/tip seal combination and packaging the plunger comprise the steps of:

inserting each of the barrel/tip seal combination and plunger into a respective first container;

sealing the respective first containers;

inserting the respective sealed first containers into respective second containers;

sealing the respective second containers;

transporting the respective sealed second containers to an environment less clean than a class 100 environment;

inserting the respective sealed second containers into respective third containers; and sealing the respective third containers.

15. The process of claim 14, further comprising the steps of:

prior to final assembly of the syringe, transporting the packaged barrel/tip seal combination and packaged plunger to a receiving site being less clean than a class 100 environment;

removing each of the packaged barrel/tip seal combination and packaged plunger from the respective sealed third containers;

transporting each of the packaged barrel/tip seal combination and packaged plunger to a feedthrough area; and removing each of packaged barrel/tip seal combination and packaged plunger from the respective sealed second containers.

16. The process of claim 15, further comprising the step of:

after transporting each of the packaged barrel/tip seal combination and packaged plunger to the final assembly site, removing each of the packaged barrel/tip seal combination and packaged plunger from the respective sealed first containers.

17. The process of claim 1, further comprising the step of:

after final assembly of the syringe, sterilizing the prefilled syringe.

18. The process of claim 2 wherein the final assembly site is at least a MCB-3 environment.

19. The process of claim 2, further comprising:

prior to final assembly of the syringe, transporting the packaged barrel/tip seal combination and packaged plunger to a receiving site being less clean than a class 100 environment;

removing each of the packaged barrel/tip seal combination and packaged plunger from the respective sealed third containers;

transporting each of the packaged barrel/tip seal combination and packaged plunger to a feedthrough area; and removing each of packaged barrel/tip seal combination and packaged plunger from the respective sealed second containers.

20. The process of claim 3, further comprising:

prior to transporting the packaged barrel and packaged tip seal to the first assembly site, transporting the packaged barrel and packaged tip seal to a receiving site being less clean than a class 100 environment;

removing each of the packaged barrel and packaged tip seal from the respective sealed third containers;

transporting the packaged barrel and packaged tip seal to a feedthrough area; and removing each of the packaged barrel and packaged tip seal from the respective sealed second containers.

21. The process of claim 3, further comprising:

prior to transporting the packaged plunger substrate and packaged plunger cover to the second assembly site, transporting the packaged plunger substrate and packaged plunger cover to a receiving site being less clean than a class 100 environment;

removing each of the packaged plunger substrate and packaged plunger cover from the respective sealed third containers;

transporting the packaged plunger substrate and packaged plunger cover to a feedthrough area; and removing each of the packaged plunger substrate and packaged plunger cover from the respective sealed second containers.

22. The process of claim 1, further comprising the step of filling the assembled barrel/tip seal combination at the final assembly site with a contrast fluid.

* * * * *